United States Patent [19]

Mitchell et al.

[11] Patent Number: 4,889,396

[45] Date of Patent: Dec. 26, 1989

[54] DRAWER INTERLOCK

[75] Inventors: Terry L. Mitchell, Jenison; Fredrick E. Sutton, Grand Rapids; Todd A. Sutton, Spring Lake, all of Mich.

[73] Assignee: G. A. Richards Company, Grand Rapids, Mich.

[21] Appl. No.: 283,166

[22] Filed: Dec. 12, 1988

[51] Int. Cl.[4] ..... E05C 7/06

[52] U.S. Cl. ..... 312/221; 312/217

[58] Field of Search ..... 312/216–221

[56] References Cited

U.S. PATENT DOCUMENTS

| | | | |
|---|---|---|---|
| 4,355,851 | 10/1982 | Slusser | 312/221 X |
| 4,429,930 | 2/1984 | Blovin | 312/221 X |
| 4,480,883 | 11/1984 | Young | 312/221 |
| 4,768,844 | 9/1988 | Ludwig | 312/211 |

*Primary Examiner*—Joseph Falk

*Attorney, Agent, or Firm*—Miller, Morriss & Pappas

[57] ABSTRACT

A drawer interlock combination for a stack or tier of drawers and simplified to include a frame forming a receptacle guide for a plurality of rotors, one rotor for each drawer in the stack and the same frame guiding a plurality of actuators, one for each drawer through a path limited in both extremes of travel and displaceable by the action of only one of the rotors so that only a single drawer may be opened at a time and plural drawers cannot be opened concurrently. The device may be completely locked by simple blocking of the travel of the actuators to less displacement than by an single of the rotors. The structure is simple, economical and easy to install. The parts repeat themselves and provide excellent drawer stabilization with overall locking of all drawers.

6 Claims, 3 Drawing Sheets

DRAWER INTERLOCKDRAWER INTERLOCk

The present invention is directed to a new and improved drawer interlock structure that is simple in construction, easy to install and requires minimal installation space while effectively achieving a lock control over drawers as used in file cabinets desks and tiered storage facilities. In addition the present structure is easily locked by simple blocking and is economic to use.

As a general observation of the prior art background all of prior drawer interlocks have had the common objective of prevention of the simultaneous opening of drawers in a stacked relationship by the opening of any single one of the drawers. This has been desireable in preventing an overbalance by opened drawers which would tip over the desk or stack of file drawers. More and more this problem appears in desk furniture as the furniture tends to overhang the base supports and this creates extreme uncertainties as plural drawers are opened.

The art is crowded with devices of increasing complexity and primarily to assure that concurrent opening of plural drawers cannot occur. The complexity has resulted in high cost solutions to the provision of effective and efficient drawer interlocks. The present invention simplifies the problem of drawer interlocks and provides an economical and simplistic solution much sought after in the furniture industry.

In the Drawings

Figure 4:
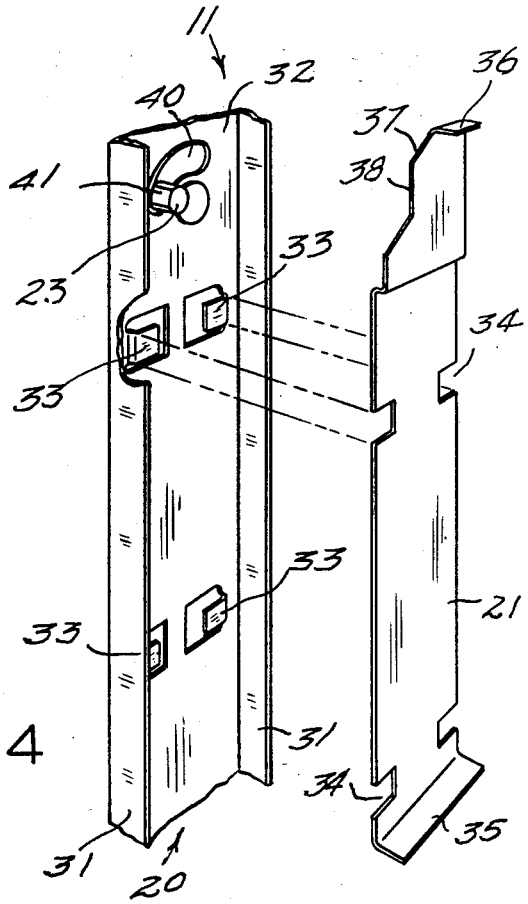

FIG. 4 is a partial composite and assembly related perspective view of a lifter element serving a drawer and a channel track piece showing one of the rotors in place and with a tang extending through an arcuate guide slot in the web of the channel frame. The profile of the upper portion of the lifter element is clearly revealed and functions to provide position-controlled blocking of the arcuate movement of the tang.

Figure 5:
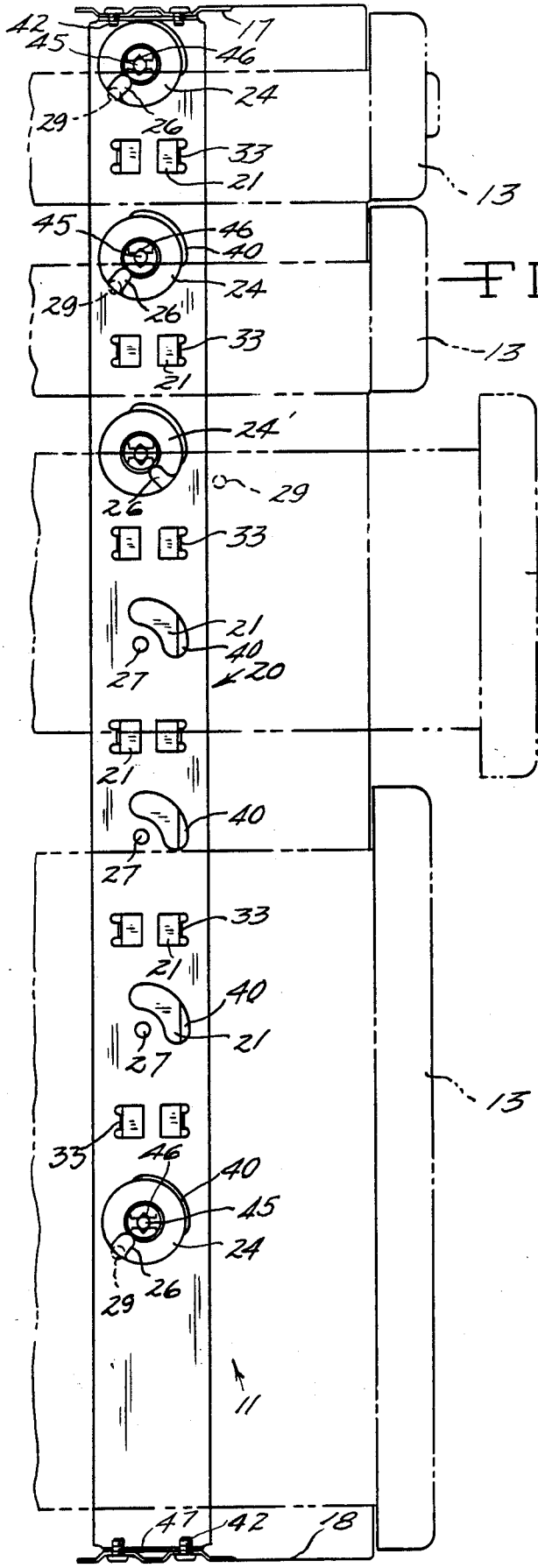

FIG. 5 is a side elevation view of a stack of drawers of variant heights in phantom-line each shown in relation to the rotor carried on the channel frame of the interlock and with drawer in locked position as a consequence of the withdrawal of a single one of the plural drawers as shown.

Figure 6:
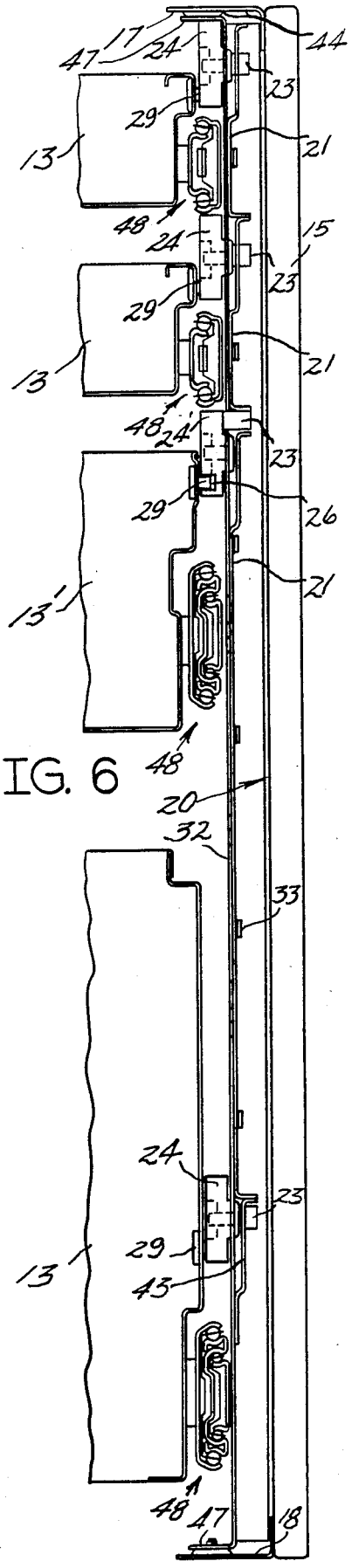

FIG. 6 is an end elevation view of the stack of drawers seen in FIG. 5 and the drawers are in typical antifriction suspension glides and under the locked condition seen in FIG. 5 when one drawer has been opened.

Figure 7:
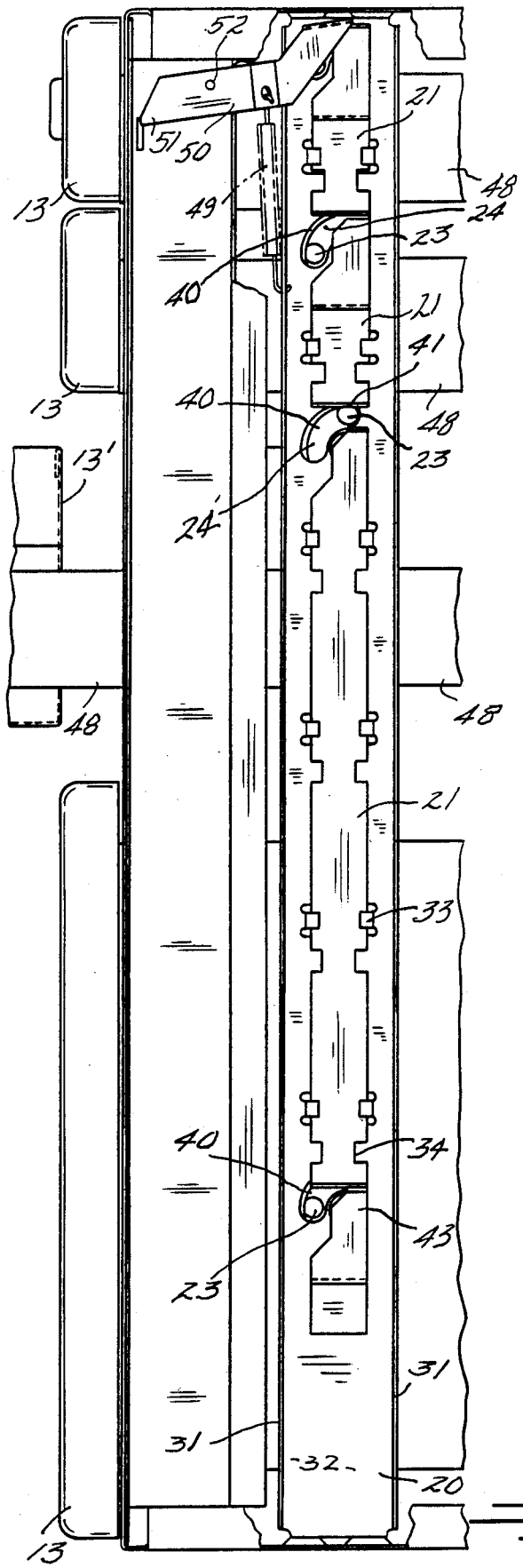

FIG. 7 is a side elevation view of the stack of drawers seen in FIG. 5 from the side of the channel frame opposite the rotors and illustrating the actuator elements in the blocking position by the opening of the intermediate drawer by reason of the actuator stack above the opened drawer being blocked from their open position by the tang of the rotor serving the opened drawer and the actuator beneath the opened drawers are shown blocked against lifting by the rotor positioning of the tang against the blocker flanges of the upper and lower actuators thereby preventing any movement of the rotors and locking those drawers served by their respective rotors against opening.

Figure 8:
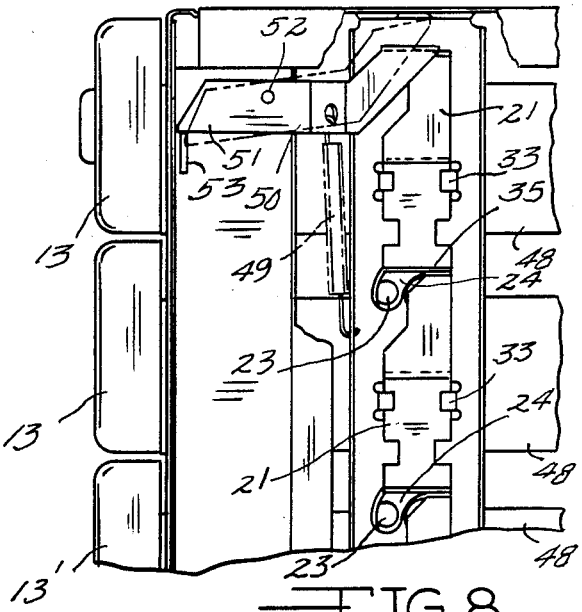

FIG. 8 is a fragmental side elevation view of the structure of FIG. 7 and showing the simple lock tilted to lock position upon the closing of all drawers and selectively locking the entire stack against any drawer withdrawal when the latch element is served as by blocking it.

Figure 9:
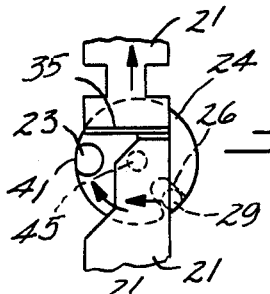

FIG. 9 is a side elevation view of the closed drawer position of a rotor and the force arrows show the direction of rotation of the rotor upon opening of a drawer served by the rotor and the shifting of position of the tang element of the rotor as it rises toward the broad flange of the uppermost actuator.

Figure 10:
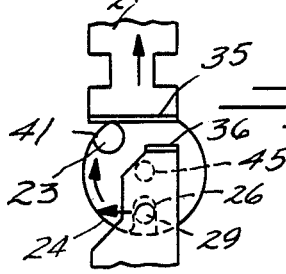

FIG. 10 is a side elevation view as in FIG. 9 and indicating contact of the tang of the rotor with the uppermost actuator thereby raising the uppermost acutator and those above it as it engages the broad lower flange of the upper actuator.

Figure 11:
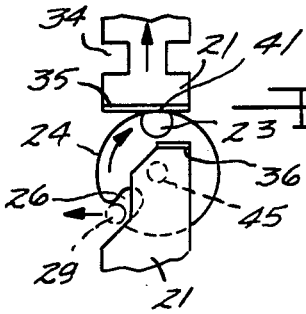

FIG. 11 is a side elevation view of the final blocking position of the tang of the rotor as the index drawer tab escapes from the indexing groove of the rotor and the flat side of the rotor tang is retained in position by the holding detent of the flange resting on the flat of the tang. The same tang then blocks any lifting motion of the lowermost actuators in prevention of rotation of lower rotors. As the drawer tab returns to closed position the reverse sequence running from FIGS. 11–9, inclusive, follows and all drawers can be opened, one at a time, and plural drawers cannot be opened simultaneously.

GENERAL DESCRIPTION

In general the present invention is a new, useful and unobvious drawer interlock combination having an elongate vertically oriented frame variously locatable within the encasement envelope of the drawers and in avoidance of interference with drawer glide structures and the like and having ninety degree arcuate openings at selected drawer intervals. On a center corresponding to the centers for each of the ninety degree arcuate openings is a pivotal support opening through the frame. Supported pivotally in the pivotal support openings is a rotor axle or journal which projects from the disc-like body of the rotor. The rotors each include a tang which extends parallel to the axis of the rotors and offset therefrom and the tang projects through the arcuate openings in the frame. The body of the rotors is concentric about the axis of its rotor and the body includes one radial notch or slot whereby a closed drawer having a projecting pin rotates the rotor serving that drawer as the drawer is opened by engaging the notch or slot in the rotor body. Such rotation of the rotor serving a particular drawer causes the respective tang also to rotate and effectively move in the arcuate opening in the frame through an increment of lift equal to the distance between the tang and the axle or axis of the rotor. As will be appreciated plural of such rotors in spaced vertical relation, depending upon the height of the individual drawers served, are rotationally mounted on the frame. The frame is positionable in a drawer support structure in such a manner that the opening movement of the drawers and each of them urge the rotation of the rotors. The frame, preferably channel shaped, guidably supports a plurality of generally planar actuators, each actuator serving a drawer and each actuator element resting against the actuators beneath and above each other and normally biased toward contact each with the other except that the bottom-most actuator rests against a stop and the top-most actuator can rise vertically a distance of about the gap formed by the upper arcuate opening in the frame. All of the actuators are supported guideably in one side of the frame and may be selectively removed. The planar actuators are profiled to always accomplish blocking of rotation of the rotors by preventing the tang portion of the rotors from climbing when any one of the rotors has been rotated by opening a drawer in the stack of drawers. As will be appreciated if two or more drawers are simultaneously activated for withdrawal all drawers are locked because the tangs are all blocked by their respective actuators because the actuators are at their limits of movement.

The interlock of the present invention is easily attached to metal or wood furniture and very simply sized to function with any selected drawer sizes of by change in the vertical interval. The construction is simple, works well and extends interlock usage beyond the prior art. Locking of the system is a simple blocking of any raising of the column of contacting actuator elements, thereby preventing rotation of rotors.

The prior art, functionally and structurally distinguishable from the present invention, is summarized in the closest of such art and is believed found in the United States Letters Patent No. 3,900,236 to Ghoulish et al; 3,909,090 to Brechner et al; 4,239,309 to De Fouw; and 3,870,387 to Mortashed, all of whom propose complex structures for achievement of an interlock as against the stark simplicity of the present interlock structure contained in a single stamped frame carrying plural actuators and guideably and easily removable and functioning from rotor sensors reacting directly to drawer movement.

SPECIFIC DESCRIPTION

Figure 1:
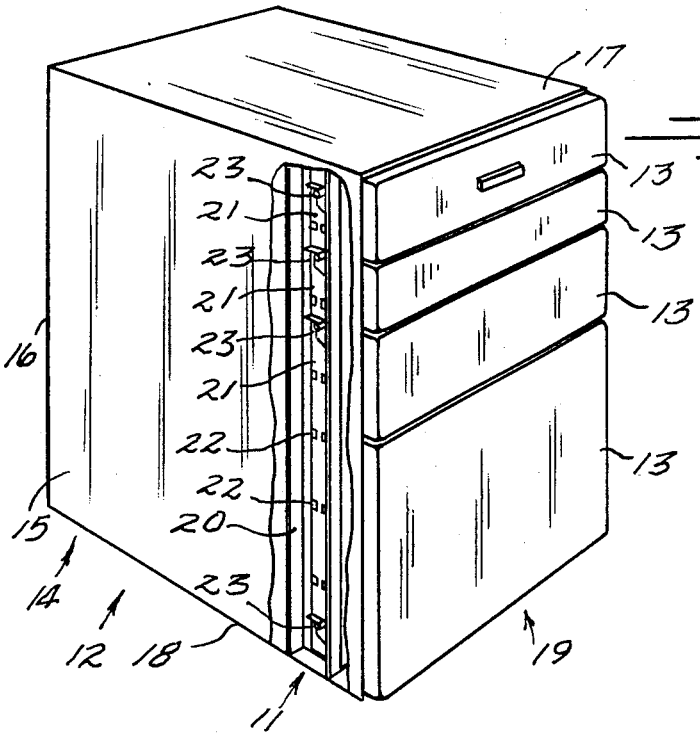
FIG. 1 is a perspective view of a stack of drawers as in a file cabinet or a tier of desk drawers and cut away to show the simplicity of the present interlock installed in the encasement of drawers.

Referring to the drawings and with first specific reference to the FIG. 1 the interlock structure 11 is illuminated in its preferred embodiment in a vertical tier pedestal or stack 12 of drawers 13 having various heights and functioning within the wrapper or enclosure 14. The wrapper 14 may be in metal, wood, or plastic material and laminates thereof and will be understood to include drawer glides or guides which permit sliding or rolling (anti-friction) opening of the drawers 13. In general, such wrappers 14 include a pair of side panels 15 in spaced apart relation, a back panel 16, usually a top panel 17 which may be a desk or table surface, and frequently a bottom closure 18. In some instances the tiers or stacks 12 are modules and are piled on top of each other or are located on a small base supporting the stacks 12. The front 19 of the stack 12 accommodates opening and closing of the drawers 13. The interlock assembly 11 locatable variously in the encasement 14 may be located on either side of the stack 12 and at selected points between the front 19 and back 16 adjacent the sides of the drawers 13 as will be seen and accesibly oriented for rotor engagement with the drawers 13 during opening and closing. The rotors 24 extend on the drawer side of the frame 20 and perform as sensor monitoring drawer withdrawal and entry of the drawers, one at a time and activating means preventing simultaneous movement of plural drawers.

The interlock assembly 11 consists of a frame 20 which is elongate and vertically oriented. It is preferred as channel shaped. The frame 20 guideably receives a plurality of actuators or plates 21 in vertical end to end relation in spaces sized in accord with the height of the drawers 13 served. Tabs define the guideway 22 for movement of the plates 21 and are preferred to be integrally formed from the frame 20. At intervals, the eccentric tangs 23 from rotors (not seen in the FIG. 1) are in the position occupied when all drawers 13 are closed. As will be seen the tangs 23 project through arcuate slots in the web portion of the frame 20.

Figure 2:
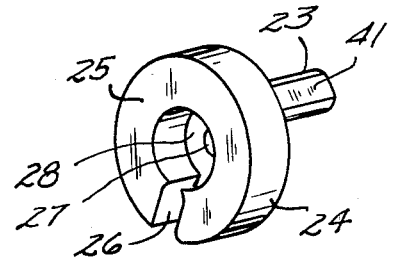
FIG. 2 is a perspective view of a rotor as used in the present invention.

In FIG. 2 the rotor or sensor 24 is seen best and the tang 23 projects from the disc-like body 25 of the rotor. The circumference perimeter of the body 25 is radially penetrated by interference means as by the radial slot 26 and an axial opening 27 is provided through the body 25 and the shoulder 28 ringing the opening 27 provides fastening access for a journalled axle or shaft (not shown). The tang 23 is thus eccentric to the axis of the rotor 24.

Figure 3:
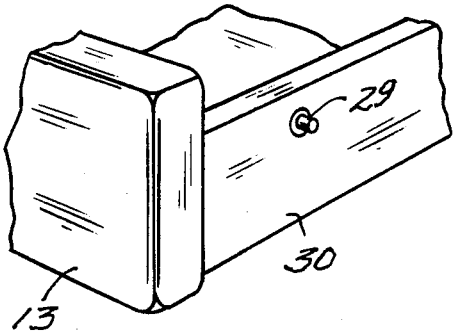
FIG. 3 is a partial perspective view of a corner of a drawer with an extending actuator pin which, as will be seen, is engaged with the rotor and which turns the rotor when the drawer is withdrawn and restores the rotor to its original position when the drawer is closed.

By reference to FIG. 3 an interference element such as the extending pin 29 protrudes from the flank piece 30 of drawers 13 and projects sidewise to operably engage the rotors 24 at the notch 26 so as to translate lineal movement of the drawer 13 to rotational movement of the rotor 24 upon opening and closing of the drawer 13. The rotational movement of the rotor 24 causes corresponding arcuate movement of the tang 23. In the FIG. 4 interlock structure 11 is better seen than in the FIG. 1 and the channel shaped frame 20 is seen in relation to one of the vertical actuators or plates 21. The flanges 31 for the frame 20 flank the web portion 32 of the channel shaped frame 20. This stiffens the frame 20 (important in selection of thin stock for the frame 20) and roughly assists in the proper orientation of actuator plates 21 at assembly while shielding the plural plates from dust and debris. The integral tabs 33 in spaced apart relation between the flanges 31 of the frame 20 are located at selected intervals over the length of the channel shaped elongate interlock element 11 and serve to locate, guide and assemble the actuator plates 21 for vertical operation in the channel shaped frame.

Notches 34 in the edges of the substantially flat actuators correspond in interval to the selector pairs of the tabs 33 in the frame 20 so that assembly and disassembly of the interlock 11 with plural actuators or plates is easily achieved and once the actuators 21 are in flat sliding guided relationship against the web 32 of the channel shaped frame 20 they move easily and freely within defined vertical limits. The integral foot plate 35 extends transversely from each of the actuators 21 to bear upon the flat bumper 36 of the next lower actuator 21 (as seen in the FIG. 1) and at the very bottom the foot 35 rests against a stop 43 as will be seen. The bumper 36 which projects transversely from the actuator 21 is limited by an upper barrier (such as the cabinet) or against a simple blocking lock surface as will be seen which serves also to apply a light spring bias to the actuator column. The upper end of the actuator 21 is on one side truncated by an upper ramp surface 37, a vertical drop edge 38 and a lower ramp surface 39 parallel and offset from the upper ramp surface 37. This arrangement, as will be seen, positions the tang 23, extending through the arcuate opening 40, in the position shown and (upon assembly) into the pocket or gap in the actuator 21 defined by the lower ramp 39 and the drop edge 38 and below and adjacent the foot 35 of the next adjacent actuator or plate 21. As will be seen, then, as a drawer 13 is opened the tang 23 rises in the arcuate opening 40 in accord with rotation of rotor 24 on the axis of the rotor 24 and cleared in that motion by the upper ramp surface 37. Thus the tang 23 in rising from the lower position in the slot 40 to a higher position raises the next highest actuator or plate 21 and substantially blocks any upward movement of actuators 21 below the tang 23 since the upper ramp surface 37 cannot pass the tang 23 and all actuators 21 beneath the raised actuator 21 are also disabled. The flat 41 on the tang 23 in the elevated position detents against the bumper 35 of the next highest of the actuators 21 thereby holding the rotor 24 against reversal of position in the arcuate opening 40 until the closing of the drawer 13 whereupon the interference engagement of the extending pin 29 positionally drives the rotor 24 (and tang 23) to the position as shown in FIG. 4.

In FIG. 5 the interlock 11 is shown in full line and the drawer sides or flanks 30 are in phantom line so that the interlock 11 is positioned between a top panel 17 and a bottom closure panel 18 or other structural portions of either of the panel sides 15. Fasteners 42 such as screws through end tabs 47 integral with the channel shaped frame 20 secure the interlock 11 in selected position. As will be appreciated welding, brazing or other fastening means well known in the art are useable depending on the materials of the drawer structure and mode of construction of the desk, table, drawer, cabinet assemblage. All drawers 13 are closed but the drawer 13' has been opened and the pin 29 extending from the flank portion 30 of the drawer 13' has rotated one of the rotors 24' to the position indicated thereby causing the tang 23 of rotor 24' to move upward through ninety degrees of arc in the arcuate opening 40. The rotor 24' detents in this position awaiting the return of drawer 13' and rotation to the starting point of the tang 23 as shown in FIG. 4. As shown in FIG. 5 and as explained in reference to FIG. 4 the drawer 13 below the drawer 13' cannot be opened because the rotors 24 are blocked from rotation since the pins 29 cannot turn their respective rotors 24 because the tangs 23 are blocked against rotation by the position of the rotor 24' and its tang 23 and the tang 23 of rotors 24 are all blocked from rotation by the walls 38 between ramps 37 and 39. Further, any simultaneous opening movement by plural of the drawers 13 is defeated by the jamming of the tangs 23 between the ramp 37 in all of the actuators or plates 21 in attempting to rotate through the ninety degrees and the entire actuator column is then blocked from rising by the requirement of plural openings to accommodate plural of the tangs 23. The entire interlock 11 becomes locked as between the lower stop 43 and the upper limiting stop 44 such as the barrier of the top panel 17. The axle elements 45 axially through the rotors 24 are clearly visible and the retaining clips 46 secure the axle journal relation. As a collateral advantage the interlock 11 may be perforated at selected intervals to accommodate, in a single unit, a variety of drawer heights and those combinations may be selectively assembled with properly sized actuator 21 requiring only adjustement as to length. The rotors 24 are uniform in size and are preferred in durable dimensionally stable and quiet running plastics such as found in the nylon or polyamide resins.

The FIG. 6 further illuminates the structure described in the FIG. 5. The integral mounting ears 47 (top and bottom) on the channel shaped frame 20 provide convenient and economical mounting means and extend from the central web of the frame 20. These may be secured by suitable fasteners to wood or metal wall skeleton structure or in some instances spot welding is useful and economic. The lower stop 43 supports the lowest actuator 21 and the open position revealing the radial slot 26 is seen in the rotor 24' serving the pin 29 extending from the drawer 13'. FIG. 6 also indicates an anti-friction drawer suspension structure 48 as frequently used in quiet smooth functioning drawer support.

FIG. 7 permits visualization of the frame 20 from the channel side and in other respects is much the same structure as seen in FIG. 6. The drawer 13' is shown open and all of the rest of drawers 13 cannot be opened until drawer 13' is closed and the rotor 24' is rotated by the drawer 13' as previously described causing the tang 23 to disengage from the detent open position and return to the bottom of the arcuate opening 40 in frame 20.

While drawer 13' is open any attempt to open other of the drawers 13 is blocked by the blocking position of all actuators or plates 21 holding the tangs 23 against withdrawal rotation of the rotors 24 until the drawer 13' frees the blockage by movement of the rotor 24' and its tang 23 by the extending pin 24 in the radial slot 26 of the rotor 24' as the drawer 13' closes. Gravity drop of the column of actuators 21 is assisted by the spring bias applied by the spring 49 tensionally connected on one side to the frame 20 and on the other side to follower 50 of a lock lever 51 shown in the unlocked position on the pivot 52. When all drawers 13 and 13' are closed, any one of the drawers 13, 13' can be opened, but no more than one at a time by reason of the described simple interlock structure.

By reference to FIG. 8 the column of actuators 21 are in the position when all drawers 13 and 13' are closed. In this position the drawer structure is easily locked against opening, as seen by blocking the lever 51 by a simple bar rest 53 extended to underly the lever 51. Since the actuators cannot rise, no drawers 13 can be opened until the bar rest 53 is disengaged from the lever 51. Pulling on the drawers 13 will not open the drawers because the tangs 23 cannot lift the column of actuators 21 and rotors 24 cannot be rotated.

The FIGS. 9, 10 and 11 best express the function of the rotors 24 in the opening of a drawer 13 from rest position (FIG. 9) to the lock position of all other drawers by lifting relocation of the tang 23 of the rotors 24 (FIGS. 10 and 11) and to detent rest position for the rotor 24 as it awaits closure of the drawer it serves by the interference passage of the pin 29 in the radial slot 26 of the rotor 24. The escapement of the pin 29 upon opening is seen in motion direction arrows and the flat of the tang 23 (as shown) in combination with the return bias (gravity or spring) against the upper plates 21 retains the rotor 24 in poised position ready to receive the pin 29 upon drawer closure and to overcome the detent bias and return the entire interlock structure to the position of FIG. 9 awaiting opening movement.

The simplicity of the structure of the described interlock is readily apparent over prior art structures and the economies to be realized from the interlock and its preferred embodiment, as shown, is also clear. The actuators 21 are positioned in intervals selected in accord with drawer size and the connection and adaptaton of identical rotors 24 utilizing plural identical mountings on the frame 20 where the frame 20 is adapted to a wide range of installational limits, right, left and fore or aft in drawer pocket depth can be instantly comprehended by those skilled in the art. Finally the interlock units adapt well by location or positioning to a wide range of key locks, either directly acting on the actuator column or in range of suitable levers.

It will be appreciated that the manufacture of the actuators 21 and frames 20 can be modular to accommodate families of sized drawers as perceivable in the FIG. 5 when regular or irregular interval locations of the rotors 24 with journalling of the rotors 24 in the frame 20 allow various drawer combinations in top to bottom order.

Finally, those familiar with the problems connected with drawer interlocks will appreciate the minimal lost space using the compact channel frame, nesting, stacked actuators, and tabular mounting facilities adaptable to an indeterminate number of desk styles. This is especially important in modern desk construction with anti-friction drawer glides.

Having thus described our invention and the preferred embodiment thereof, those ordinarily skilled in the art to which the invention pertains will appreciate changes, modifications and improvements in the interlock described and such modifications, changes and improvments are intended to be included herein limited only by the scope of our hereinafter appended claims.

We claim:

1. An improved drawer interlock combination in prevention of opening plural stacked drawers simultaneously and preventing a second drawer from opening when one drawer is opened, comprising:

a plurality of drawer blocking rotors in spaced apart vertical relation each having a central journal means, a tank extension offset from said journal means providing engaging means in interference engagement with corresponding of said drawers for limited movement when said corresponding drawer is opened and closed;

an elongate frame to which said rotors are rotationally connected and through which said tangs extend in spaced relation and limiting the arcuate rotation of said tangs and said frame including a lower stop beneath said lowermost tang;

a plurality of actuators in end to end relation guidable in limited vertical movement in said frame, and each notched at its uppermost end and each liftingly movably engaged by said tang through a distance substantially equal to the thickness of said tangs in their upper extreme of arcuate travel, the lowermost of said actuators normally resting on said lower stop of said frame.

2. An improved drawer interlock combination in prevention of opening plural drawers simultaneously or a second drawer when one drawer is opened comprising:

an elongate frame;

a plurality of spaced apart rotors journalled by said frame and a tang from each of said rotors, extending through said frame and describing an arc around said journals of said rotors limited by said frame and said rotors each rotated through a limited arc by selected engagement with a corresponding adjacent drawer;

a plurality of actuators guidably movable along the length of said frame for limited upward movement and engaged with one another in end to end relation each of said actuators having a notched upper end selectively engageable with said tang of said corresponding rotors, any one said tang upon opening a corresponding drawer moving said actuators through said limited upward movement and thereupon blocking said return movement of said actuator until said tang is returned by closing rotation of said rotor and blocking said lower rotors from lifting movement;

and a barrier beneath the lowermost of said actuators assuring said limited upward movement upon raising said actuators a distance established by the lift movement of one of said tangs.

3. An improved drawer interlocked combination comprising:

a channel-like elongate frame having a web portion and flanking elongate flange portions, the web portion of said frame defining spaced apart openings and with stock from said openings inturned to form guideways in said web portion and said web portion also defining at least one arcuate slot through an amplitude of about 90 degrees, and said frame including mounting means and stop means positioned beneath the uppermost portion of the lowermost of said arcuate slots;

at least one flat actuator plate having a broad lower flange and a narrower upper flange and said actuator plate notched on the longitudinal edges thereof for flat working assembly and disassembly in said guideways of said frame; and rotors each having a slotted disc-like body and a tang extending from said disc-like body in a direction parallel to and offset from the axis of said disc-like body and said rotors each on a shaft on said axis thereof operably and rotatably connected through said frame and said tang extending through said arcuate slot in said frame, said tang in one extreme of motion elevating an uppermost of said actuators by lifting engagement of the lower flange thereof and in blocking engagement with any lower of said actuators and said rotor moving in accord with operative engagement with a tab extension of one of said drawers in passing engagement with said slot in said rotor.

4. A plural drawer interlock for a plural drawer stack of drawers comprising:

an elongate frame defining a longitudinal guide way;

a plurality of actuator plates selectively moveable in said guideway of said frame each of said actuators in following contact with the next adjacent actuator;

a stop beneath the lowermost of said actuators;

a plurality of arcuate openings through said frame, said openings each having an upper limit and a lower limit, the upper limit directly above each actuator plate and said stop;

a plurality of radially slotted rotors and rotatably connected to one side of said frame and each having a tang element offset from the axial center of said rotor, said tang extending through said frames and said corresponding arcuate openings;

a stop shoulder extending transversely from the top and bottom of each of said actuator plates, and the top stop shoulder of each of said plates being smaller than the bottom shoulder and resting normally against said next adjacent shoulder and the bottom-most actuator plate against said stop, and the uppermost ends of said actuator plates cut away on one side providing a barrier permitting full vertical rise of said actuators by lift imported to any one of said actuators by rotation of said corresponding tang rotating with displacement of a single said rotor and thereupon blocking rotation of all of the other of said rotors by interference with tang movement by said barrier and in restraint of further upward movement; and a drawer tab extending laterally from each of said drawers and operably engaged in said slot of corresponding of said rotors and rotating said rotors and said tangs from one lower extreme of said arcuate opening to the upper extreme of said arcuate opening upon opening of said drawer and returning said tang to the lower extreme of travel in said arcuate slot upon selective closure of said drawer whereby only a single of said drawers can be opened at one time in said stack of drawers.

5. In a stack of plural stacked drawers in an encasement supporting drawers movably in and out, the drawer interlock combination comprising:

an elongate vertically oriented frame having selected arcuate 90-degree openings at selected drawer intervals;

a plurality of radially slotted rotors on a rotational axis operably supported by said frame and said rotors each having a tang protecting from said rotors in a direction paralleling and offset from said axis and said tangs extending through said arcuate openings;

means extending from each of said drawers and in the closed position resting in the slot of said rotors whereby said tang is at the lowest extreme of travel in said arcuate opening.

6. In a drawer interlock the improved construction comprising:

an elongate channel like frame having linear elongate guide means and plural spaced apart arcuate openings through the web portion therof and including journal openings one at the radial center of each of said arcuate openings and a rest means limiting the length of said guide means;

elongate actuators insertable and movable in said guide means of said frame and in relative flat engagement with said web portion of said frame and the lowermost of said actuators engaged on said rest means limiting movement of said lowermost actuator in one direction;

a plurality of identical rotors rotatably mounted through said journal openings of said frame and each including an eccentric radially disposed drawer engaging portion and a tang in spaced relation to said journal openings and extending operably through said arcuate openings of said frame thereby limiting rotational movement of said rotors, said tang including detent means selectively engageable with said actuators; and a drawer extension pin in interference passing engagement with each of said rotors whereby upon movement of one of said drawers said corresponding rotor is turned to a detent position and said actuators above said rotor are lifted and said actuators below said tang are blocked from movement while said single drawer is opened and upon attempted movement of plural of said drawers there is no room for release of said plural drawers.

* * * * *